US006314926B1

(12) United States Patent
Meneely et al.

(10) Patent No.: US 6,314,926 B1
(45) Date of Patent: Nov. 13, 2001

(54) VALVE CONTROL APPARATUS

(75) Inventors: Vincent A. Meneely, Langley (CA); Robert B. Price, Manchester, CT (US)

(73) Assignee: Jenera Enterprises Ltd (CA)

( * ) Notice: Subject to any disclaimer, the term of this patent is extended or adjusted under 35 U.S.C. 154(b) by 0 days.

(21) Appl. No.: 09/317,165

(22) Filed: May 24, 1999

(51) Int. Cl.[7] ..... F01L 1/34

(52) U.S. Cl. ..... 123/90.16; 123/90.12; 123/90.46; 123/320

(58) Field of Search ..... 123/90.12, 90.16, 123/90.36, 90.43, 90.46, 320, 321, 322

(56) References Cited

U.S. PATENT DOCUMENTS

| | | | | |
|---|---|---|---|---|
| 3,332,405 | | 7/1967 | Haviland . | |
| 3,367,312 | | 2/1968 | Jonsson . | |
| 3,547,087 | | 12/1970 | Siegler . | |
| 4,104,996 | * | 8/1978 | Hosono et al. | 123/90.43 |
| 4,173,209 | | 11/1979 | Jordan . | |
| 4,175,534 | | 11/1979 | Jordan . | |
| 4,398,510 | | 8/1983 | Custer . | |
| 4,510,900 | | 4/1985 | Quenneville . | |
| 4,523,551 | | 6/1985 | Arai et al. . | |
| 4,592,319 | | 6/1986 | Meistrick . | |
| 4,664,070 | | 5/1987 | Meistrick et al. . | |
| 4,688,384 | | 8/1987 | Pearman et al. . | |
| 4,711,210 | | 12/1987 | Reichenbach . | |
| 4,930,463 | | 6/1990 | Hare, Sr. . | |
| 5,014,829 | | 5/1991 | Hare, Sr. . | |
| 5,103,779 | | 4/1992 | Hare, Sr. . | |
| 5,158,109 | | 10/1992 | Hare, Sr. . | |
| 5,507,261 | * | 4/1996 | Johnson, Jr. | 123/322 |
| 5,526,784 | | 6/1996 | Hakkenberg et al. . | |
| 5,537,976 | | 7/1996 | Hu . | |
| 5,540,201 | | 7/1996 | Feucht et al. . | |
| 5,596,960 | * | 1/1997 | Hazen | 123/90.46 |
| 5,609,133 | * | 3/1997 | Hakansson | 123/321 |
| 5,647,318 | | 7/1997 | Feucht et al. . | |
| 5,680,841 | | 10/1997 | Hu | 123/322 |
| 5,746,175 | | 5/1998 | Hu . | |
| 5,758,620 | * | 6/1998 | Warner | 123/321 |
| 5,794,589 | | 8/1998 | Hakansson . | |
| 5,829,397 | | 11/1998 | Vorih et al. . | |
| 5,839,453 | * | 11/1998 | Hu | 123/322 |
| 5,890,469 | | 4/1999 | Hakansson et al. . | |
| 5,975,251 | * | 11/1999 | McCarthy | 123/90.39 |

FOREIGN PATENT DOCUMENTS

| | | |
|---|---|---|
| 422254 | 11/1925 | (DE) . |

* cited by examiner

*Primary Examiner*—Thomas Denion
*Assistant Examiner*—Tu M. Nguyen
(74) *Attorney, Agent, or Firm*—Liniak, Berenato, Longarce & White, LLC

(57) ABSTRACT

A valve control apparatus is provided for an internal combustion engine having a valve and a camshaft. The camshaft has an axis of rotation, a first lobe and a second lobe adjacent to the first lobe. The second lobe is angularly spaced-apart about the axis from the first lobe. The apparatus includes a follower operatively engagable with the camshaft and the valve. The follower has a first operational mode where the first lobe operatively engages the follower on each revolution of the camshaft to open the valve a first time on each revolution. There is a mechanism for selectively putting the follower in a second operational mode where the second lobe operatively engages the follower to open the valve a second time on each revolution of the camshaft. The mechanism puts the follower in the second operational mode on each revolution of the camshaft before the second lobe is fully aligned with the follower. The mechanism returns the follower to the first mode after the valve is opened by the second lobe and before the first lobe fully operatively engages the follower. Maximum opening and closing of the valve by the first lobe is thereby unaffected when the mechanism selectively puts the follower in the second operational mode.

34 Claims, 14 Drawing Sheets

VALVE CONTROL APPARATUS

BACKGROUND OF THE INVENTION

This invention relates to the valve control apparatuses and, in particular, to valve control apparatuses for diesel engine compression release brakes.

Compression release brakes are used to slow diesel powered vehicles such as large tractor trailer units. These brakes work by releasing compressed gases from each cylinder near top dead center of each compression stroke. This removes the rebound effect whereby the compressed gases would tend to drive the piston downwardly and thereby counter the braking effect otherwise created when the pistons compress gases during the compression stroke. Engine brakes are normally operated when a vehicle is coasting downhill and the fuel supply to the engine has been cut off. Wear on the wheel brakes is reduced since an engine brake significantly reduces the braking contribution required from the wheel brakes.

At least one exhaust valve on each cylinder is cracked open just before top dead center of each compression stroke when the brake is operational. Some mechanism must be provided, therefore, to open each exhaust valve twice during each engine cycle. The normal exhaust valve opening occurs during the exhaust stroke when the piston is moving upwardly towards the cylinder head. The second exhaust valve opening occurs during braking operation near the top dead center position at the end of the compression stroke. Various mechanisms have been devised to selectively crack open each exhaust valve the second time during each engine cycle. In many engines, for example, a fuel injector mechanism is used to crack open each exhaust valve at the required time. However such a mechanism is not available, nor suitable for all types of engines. Accordingly, alternative mechanisms have been devised.

U.S. Pat. Nos. 5,537,976 and 5,680,841, both to Hu, disclose the concept of providing a hydraulic linkage between the camshaft and the exhaust valves. The camshaft has two lobes for each exhaust valve, a first of the lobes opening each exhaust valve normally during the exhaust stroke. The system employs a cam follower hydraulically connected to each exhaust valve. Clearance between the cam follower and the camshaft is effectively changed whereby a second cam lobe, smaller than the first lobe, actuates the valve during brake operation.

One problem with such prior art engine brakes is that the normal operation of the exhaust valve is affected during brake operation. Clearance between the cam follower and camshaft is effectively reduced during brake operation. This means that the first lobe on the camshaft opens the exhaust valve further than normal for the exhaust stroke during exhaust brake operation. In some cases it is necessary to provide recesses in the pistons so that the exhaust valves do not strike the pistons when the brake is operational. These recesses, and the abnormally extended exhaust valves, interfere with optimal engine design from the point of view of other considerations such as emission controls.

Another problem with such prior art engine brakes is that the exhaust valve overlap at top dead center is increased during brake operation. This means that exhaust gas energy is lost from the exhaust manifold to the inlet stroke of the cylinder. Recovering the lost energy would be beneficial in order to drive the turbocharger to supercharge the compression stroke.

It is an object of the invention to provide an improved valve control apparatus which overcomes the disadvantages associated with the prior art.

It is also an object of the invention to provide an improved valve control apparatus which allows a camshaft to selectively open each exhaust valve near top dead center of each compression stroke, for engine braking purposes, without interfering with normal maximum lift and closing of each exhaust valve on each exhaust stroke.

Is a further object of the invention to provide an improved valve control apparatus which is rugged and economical in construction and reliable during operation.

SUMMARY OF THE INVENTION

There is provided, according to one aspect of the invention, a valve control apparatus for an internal combustion engine having a valve and a camshaft. The camshaft has an axis of rotation, a first lobe and a second lobe. The second lobe is angularly spaced-apart about the axis from the first lobe. The first lobe extends further from the axis of rotation than the second lobe. The apparatus includes a follower which is operatively engagable with the camshaft and the valve. The follower is positioned to operatively engage the first lobe on each revolution of the camshaft and to open the valve a first time on each revolution of the camshaft. There is a mechanism for selectively changing clearance operatively between the follower and at least one of the camshaft and the valve. The mechanism selectively reduces the clearance on each revolution of the camshaft after the valve is opened by the first lobe. The follower operatively engages the second lobe and opens the valve a second time on each revolution of the camshaft when the clearance is so reduced. The mechanism increases the clearance on each revolution of the camshaft during the opening of the valve the first time and removes the clearance before the valve is opened by the second lobe.

DETAILED DESCRIPTION OF THE PREFERRED EMBODIMENTS

Figure 1:
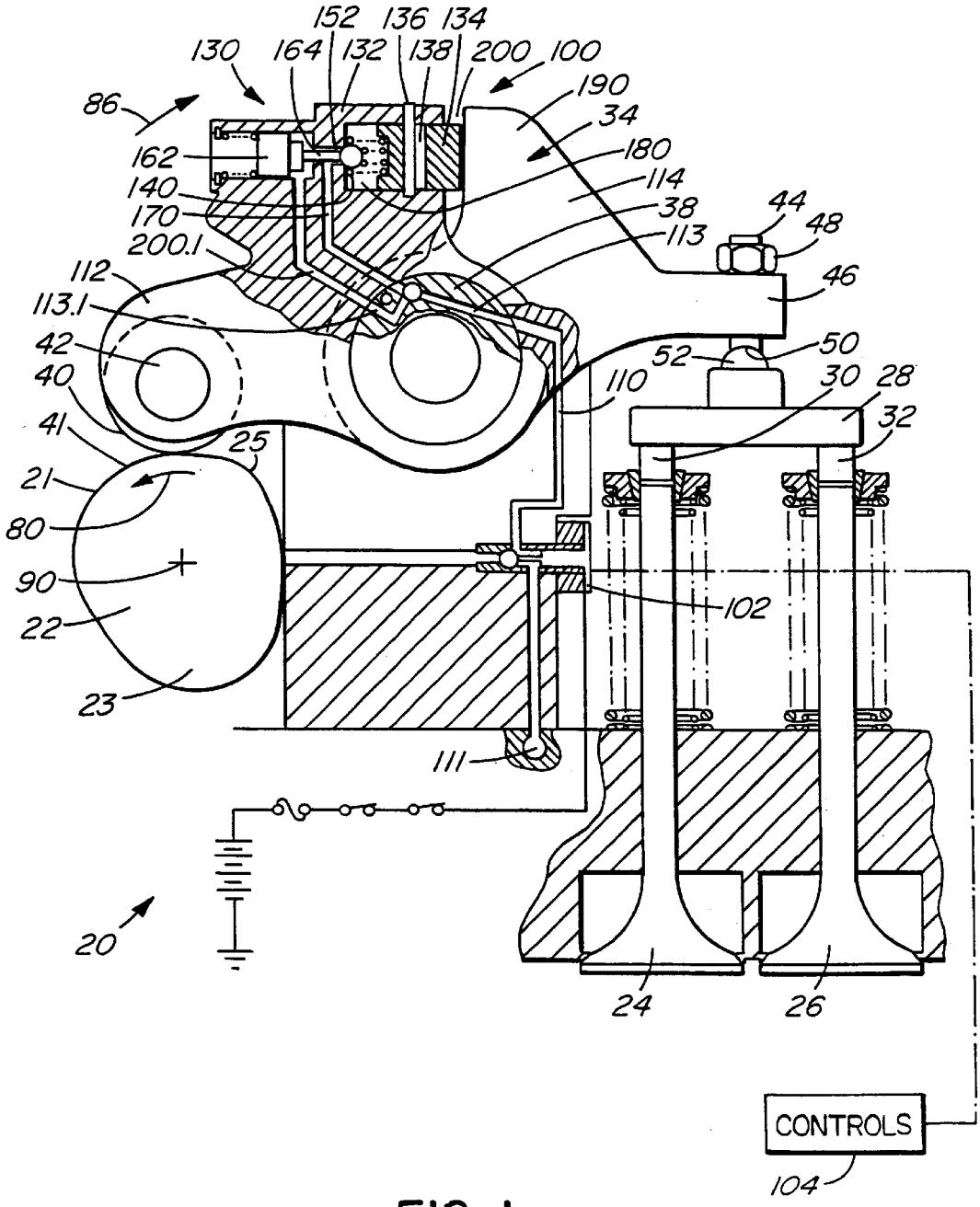
FIG. 1 is a side view, partly in section, of a fragment of a diesel engine including two exhaust valves of one cylinder thereof, a camshaft and an exhaust valve opening mechanism including a valve control mechanism, according to an embodiment of the invention, shown at the position before the start of engine braking.
Figure 2:
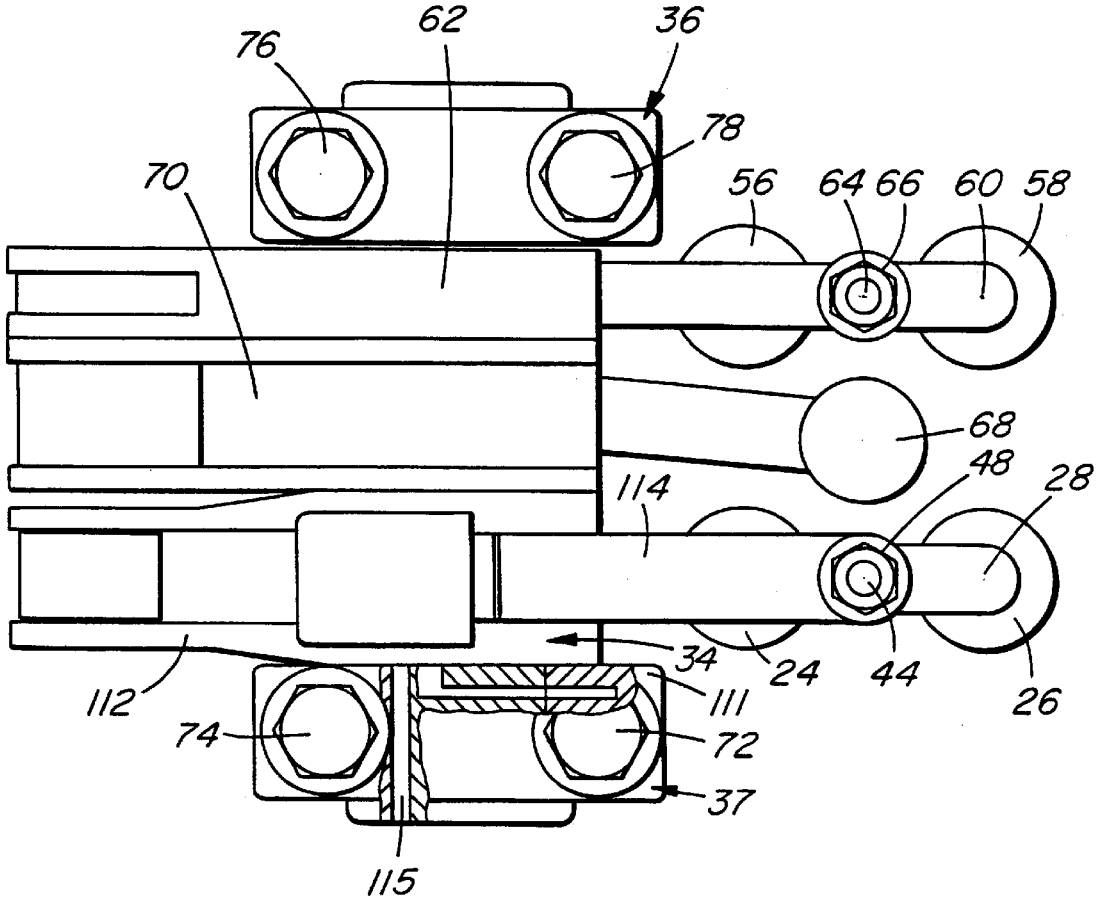
FIG. 2 is a top plan view thereof, also showing two intake valves of the one cylinder of FIG. 1, the intake valve opening mechanism and the fuel injector actuating mechanism.

Referring first to FIGS. 1 and 2, these show a fragment of a diesel engine 20 including a camshaft 22, a pair of exhaust valves 24 and 26, a cross head 28 extending across tops 30 and 32 of the two exhaust valves, a rocker arm 34, rocker arm supports 36 and 37 and a rocker arm shaft 38. The rocker arm includes a cam follower in the form of a roller 40 rotatably mounted on a shaft 42. There is a valve set screw 44 threadedly received at end 46 of the rocker arm above cross head 28. A lock nut 48 is threadedly received on the set screw adjacent the rocker arm. The set screw has a concave recess 50 at its lower end which contacts hemispherical fitting 52 on cross head 28.

Referring to FIG. 2, there is a pair of intake valves 56 and 58 on the same cylinder of engine 20 as the exhaust valves 24 and 26. These are also provided with a cross head 60, a rocker arm 62, a valve set screw 64 and a lock nut 66. There is also a fuel injector 68 actuated in this example by another rocker arm 70. The supports are provided with bolts 72, 74,76 and 78. As described thus far, the engine 20 is generally conventional. Camshaft 22 rotates in the direction of arrow 80 once for every two revolutions of the crankshaft (not shown) of the engine. A first lobe 23 is positioned in the conventional manner on camshaft 22 to open the exhaust valves 24 and 26 during the exhaust stroke of the particular cylinder of the engine where these valves are located. The lobe 23 contacts roller 40 and rotates rocker arm 34 in the direction indicated by arrow 86, causing screw 44 to press downwardly on fitting 52 of the cross head and thus open the exhaust valves.

It is known to provide clearance in the exhaust valve opening mechanism. Generally this is accomplished by adjusting screw 44 to provide a specified gap between the bottom of the screw and the cross head. Lock nut 48 maintains the proper gap. The gap however could be considered as being between the camshaft and roller depending upon the position of the rocker arm. Likewise it is known to provide clearance or play in other ways between the camshaft and the exhaust valves such that there is no actual clearance between the roller and the camshaft or the screw 44 and fitting 52. For example, hydraulic devices can replace the rocker arm and the clearance or play can simply be lost motion in the hydraulic mechanism. Thus, the term "clearance" between the camshaft, the rocker arm and the exhaust valves is used herein in the operative sense to mean some type of operative clearance or play in the system.

Engine 20 is somewhat unconventional in that camshaft 22 has a second lobe 25 located on the same portion of the camshaft as lobe 23. In other words, lobes 23 and 25 are axially aligned along axis of rotation 90 of the camshaft in this embodiment, but are angularly spaced-apart about the axis. It may be seen that lobe 23 extends further from axis 90 than lobe 25. The second lobe 25 is positioned to crack open the exhaust valves 24 and 26 near top dead center of the compression stroke to provide a compression release brake for the engine. When lobe 25 reaches roller 40, the rocker arm rotates in the direction of arrow 86, cracking open the exhaust valves.

It is neither appropriate, nor desirable to have an engine brake operate at all times. Clearly the exhaust valves should not be cracked open at top dead center of the compression stroke when the engine is providing power. The exhaust brake should only be operational, as discussed above, when the fuel supply to the engine is cut off and the vehicle is coasting. Thus there must be some mechanism for selectively engaging the roller 40 with lobe 25 during engine brake operation only. It is known in the prior art discussed above to provide variable effective clearance between the roller and camshaft for this purpose. During normal engine operation, the clearance is increased such that the roller 40 operatively contacts only lobe 23 during rotation of the camshaft, so the exhaust valves are opened only during the exhaust stroke. When the engine brake is operational, there is means for decreasing this clearance such that the lobe 25 operatively contacts the roller 40, rotates the rocker arm in the direction of arrow 86, and cracks open the exhaust valves near top dead center of each compression stroke.

However, there is a problem associated with prior art devices of this nature. When the clearance is so reduced, the exhaust valves 24 and 26 are opened further than normal during the exhaust stroke as the lobe 23 contacts the roller 40. This conceivably could cause the exhaust valves to contact the piston, causing serious damage to the engine. One way of countering this problem has been to provide pockets in the pistons to give additional clearance for the exhaust valves. However this can be detrimental to engine operation since the flows of gases to and from the cylinder can be adversely affected by the pockets.

It is not only the degree of opening of the exhaust valves which poses problems. Reducing the clearance also affects exhaust valve timing. In particular, the exhaust valves stay open longer than normal, increasing overlap with the intake valves (when both valves are open simultaneously). This may cause more exhaust energy to be dumped into the intake system instead of, for example, being available to help drive the engine turbocharger.

Another problem associated with these prior art apparatuses is that their typical rocker arm ratio is too high. The rocker arm ratio is the amount of opening of the exhaust valves divided by the amount of lift provided by lobe 23. A typical range of ratios in prior art devices would be 1.6–1.9:1. Such ratios increase loading on the camshaft. The loading is typically reduced by timing the opening of the exhaust valves early, resulting in weak engine braking.

Engine 20 optimizes the rocker arm ratio by achieving a rocker arm ratio more nearly approaching 1:1 in this preferred embodiment as may be seen with reference to FIG. 1. The distance between adjusting screw 44 and rocker arm shaft 38 is almost the same as the distance between the rocker arm shaft and point of contact 41 between the camshaft and roller 40. The lever arms are therefore more equal in length and the amount of lift at the camshaft nearly equals the amount of opening of the exhaust valves.

The engine also includes a valve control apparatus 100 which selectively reduces the operative clearance between the camshaft 22 and the exhaust valves 24 and 26 in order to operate the engine brake by cracking open the valves, near top dead center of the compression stroke, with lobe 25 of the camshaft. There is a solenoid valve 102 operatively connected to controls 104. The controls are conventional and include a switch operatively associated with the throttle of the engine such that the brake is only operational when the throttle is closed. There is also a manual switch in the cab of the vehicle, allowing the operator to operate the engine brake when the vehicle is coasting downhill. The solenoid valve allows engine oil to enter a passageway 110 when the operator closes the switch and the valve opens.

Rocker arm 34 is unconventional in that it comprises a first portion 112 and a second portion 114. Both portions are rotatably mounted on rocker arm shaft 38 as best shown in FIG. 1. Portion 112 operatively contacts the camshaft 22 by means of roller 40 and portion 114 operatively contacts the exhaust valves via screw 44, fitting 52 and cross head 28. As discussed above, both portions have nearly the same effective length measured by the distance from the center of the rocker arm shaft to the point of contact with camshaft 22 and fitting 52 respectively, providing a rocker arm ratio of nearly 1:1 for this example of the invention.

There is a mechanism 130 for selectively changing the operative clearance between the camshaft and the valves. Normally the rocker arm 34 is in a first operational mode, illustrated in FIG. 7, where on each revolution of the camshaft the first lobe 23 only operatively contacts roller 40, causing the valves 24 and 26 to open in the normal manner during the exhaust stroke only. The mechanism 130 can selectively put the rocker arm 34 in a second operational mode, illustrated in FIGS. 1, 3 and 5, where, on each revolution of the camshaft, the roller 40 is lifted by the second lobe 25 to crack open the exhaust valves near top dead center of the compression stroke. This second mode is selected by opening solenoid valve 102 with controls 104 to provide engine oil to the passageway 110 extending through rocker arm support 36 from oil line 111.

The adjusting mechanism 130 includes a hydraulic cylinder 132 with a piston 134 reciprocatingly received therein. There is a pin 136 extending through the cylinder and a bore 138 in the piston. The bore 138 is substantially wider than the pin, allowing for reciprocation of the piston in the cylinder, but limiting its movement.

Figure 7:
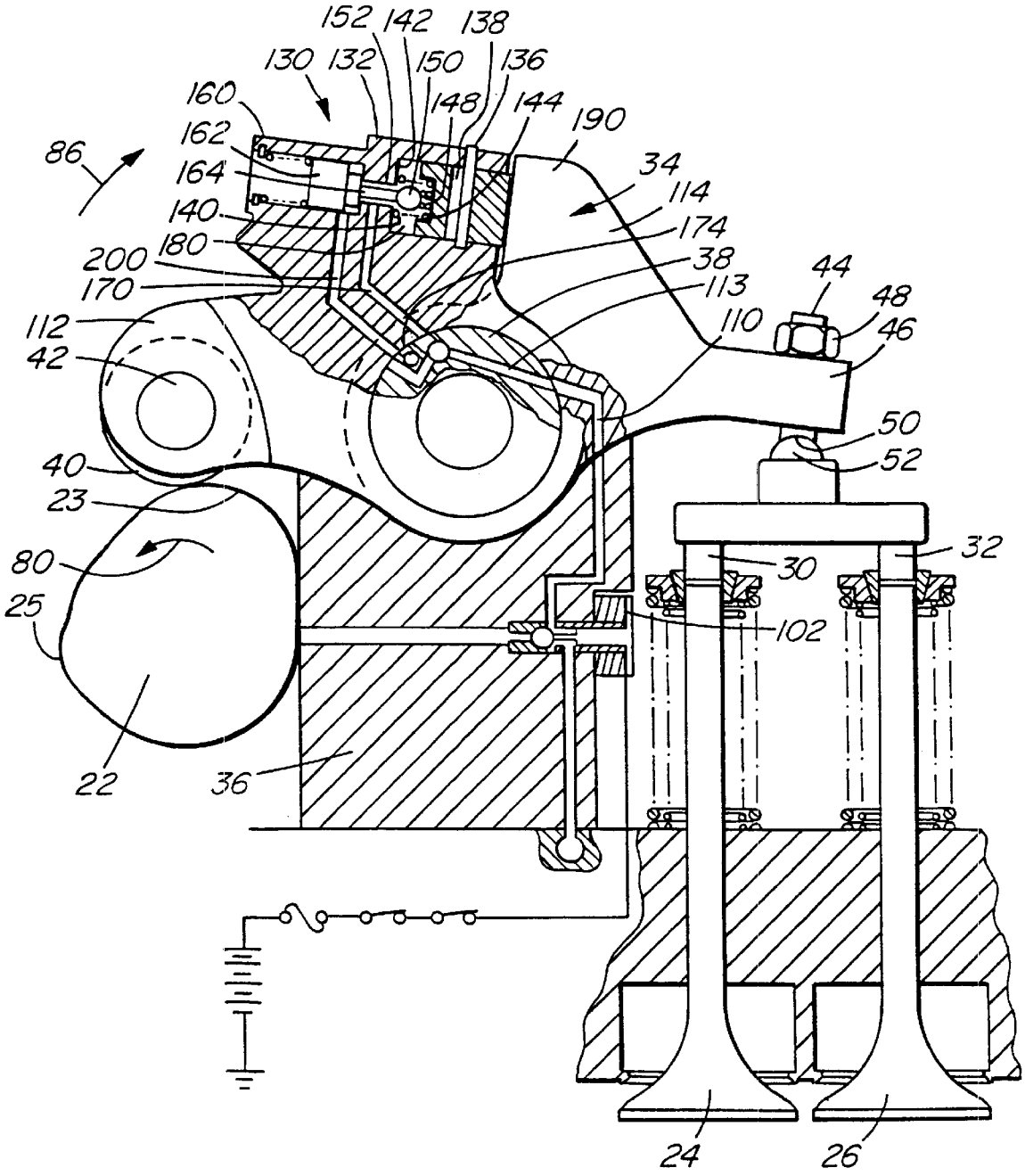
FIG. 7 is a view, similar to FIG. 5, showing the mechanism reset for the normal opening of the exhaust valves.
Figure 8:
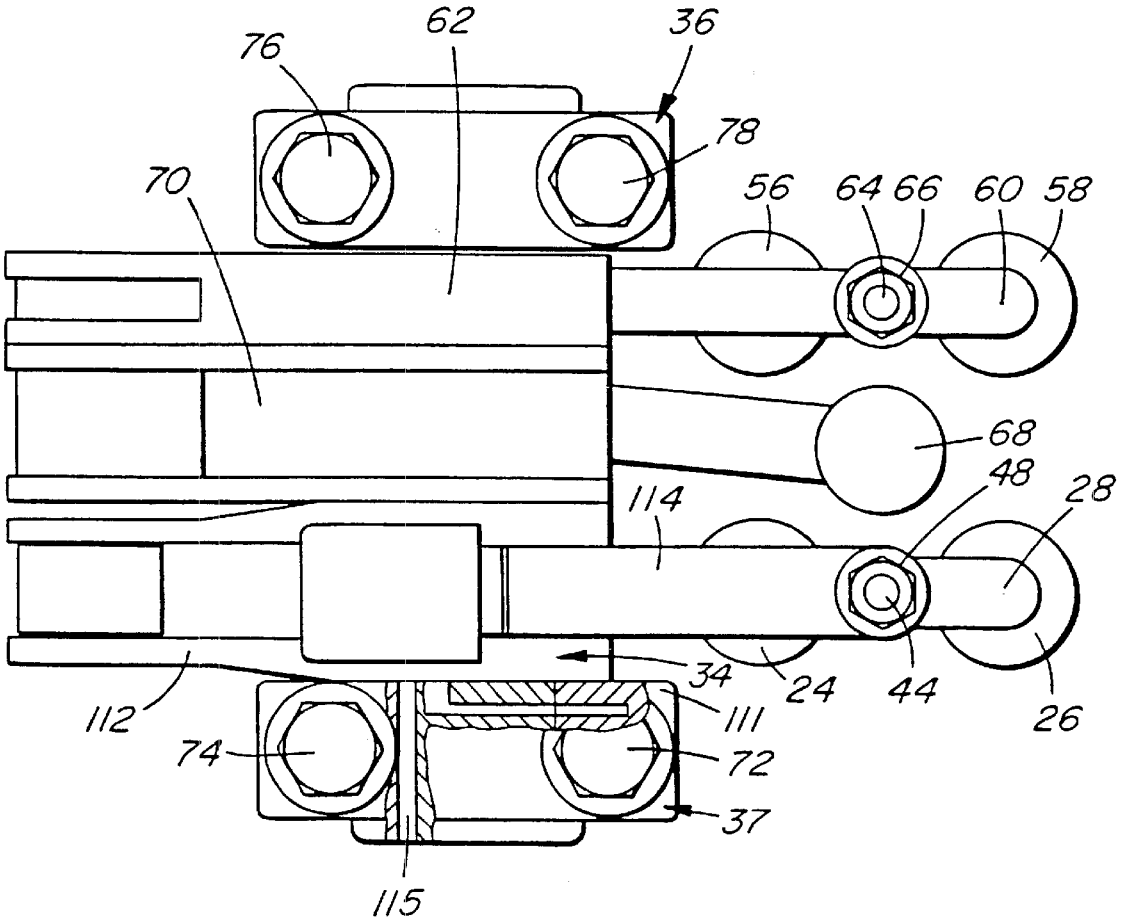
FIG. 8 is a view similar to FIG. 6, corresponding to the position of FIG. 3.

As seen in FIG. 7, there is a first coil spring 140 biased between end 142 of the cylinder and recess 144 in the piston. The spring biases the piston to the right from the point of view of FIGS. 1,3, 5 and 7. There is a smaller coil spring 148 coaxially within spring 140 and biased between the recess 144 in the piston and a ball 150. The spring biases the ball towards a position to close passageway 152.

There is a second cylinder 160, integral with cylinder 132 in this embodiment and located coaxially to the left thereof from the point of view of FIG. 7. There is a second piston 162 in the cylinder having a stem 164 extending to the right, from the point of view of FIGS. 1, 3, 5 and 7, into the passageway 152.

There is a further hydraulic passageway 170 which, from the point of view of FIGS. 1, 3, 5 and 7, extends downwardly through portion 112 of the rocker arm and then angles to the right to intersect with cylindrical bore 174 which receives the rocker arm shaft 38. Passageway 110 in rocker arm support 36 and passageway 170 in portion 112 are both aligned with a passageway 113 in the rocker arm shaft 38 for the positions of the rocker arm portions illustrated in FIG. 1 and FIG. 7. This allows oil to pass through the passageways 110, 113, 170 and 152 when the solenoid is open.

There is a chamber 180 formed in the cylinder 132 between the piston 134 and end 142 of the cylinder. Oil can pass from passageway 152 and into the chamber 180, unseating ball 150, when the rocker arm portions are in this position. The ball 150 acts as a check valve, trapping the oil within the chamber 180. At the same time, the spring 140 biases the piston 134 to the right and against upward extension 190 on portion 114 of the rocker arm, to rotate the two portions 112 and 114 to the positions shown in FIGS. 1, 3 and 5, with the piston 134 projecting outwardly from the cylinder 132. The two portions of the rocker arm are thus moved away from each other and reduce operative clearance between the camshaft and the exhaust valves during brake operation.

Figure 5:
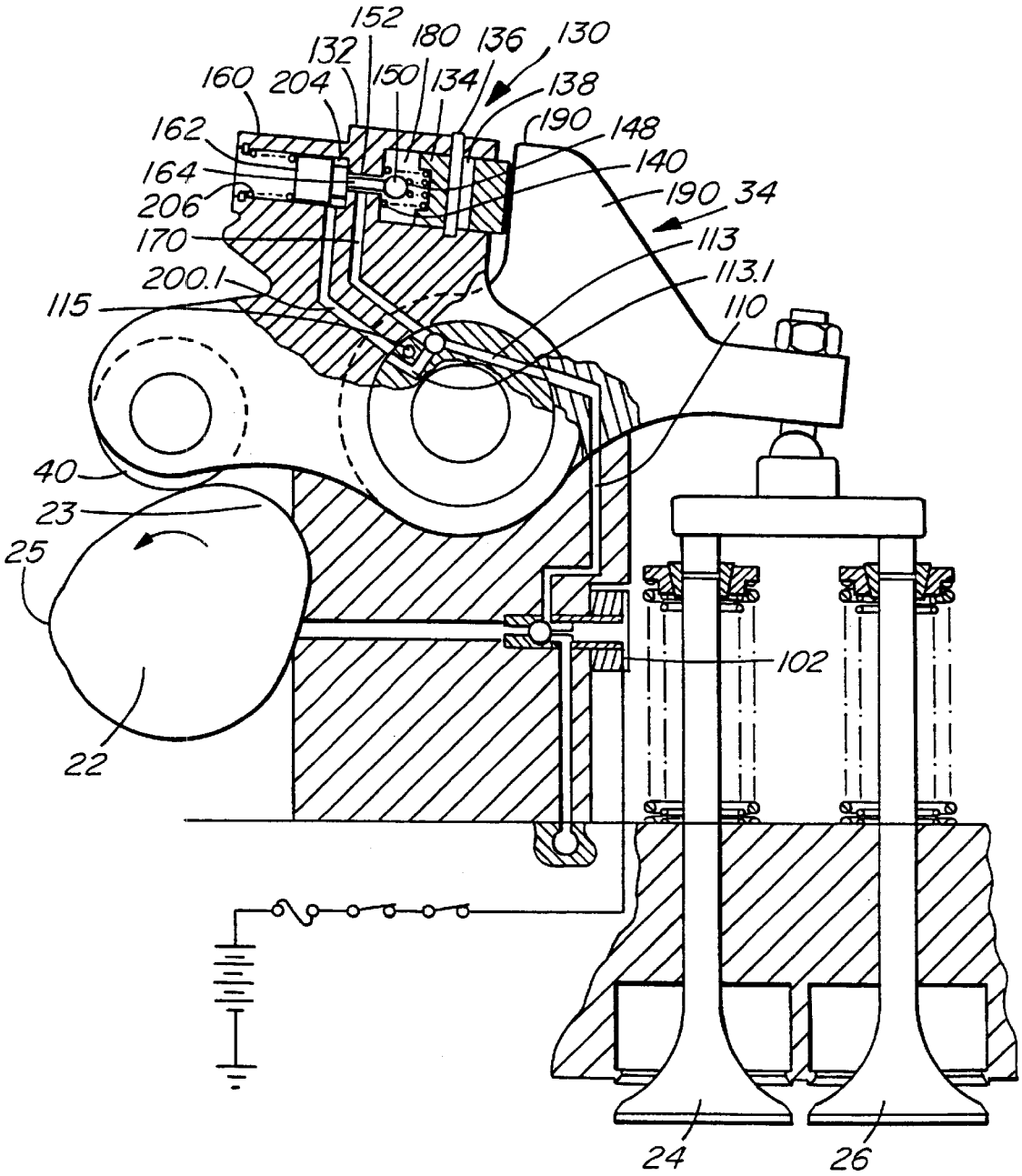
FIG. 5 is a view similar to FIG. 1, after the cracking open of the exhaust valves, as the exhaust valves begin to open on the normal exhaust stroke, and before resetting of the mechanism for the normal opening of the exhaust valves for the exhaust stroke.
Figure 6:
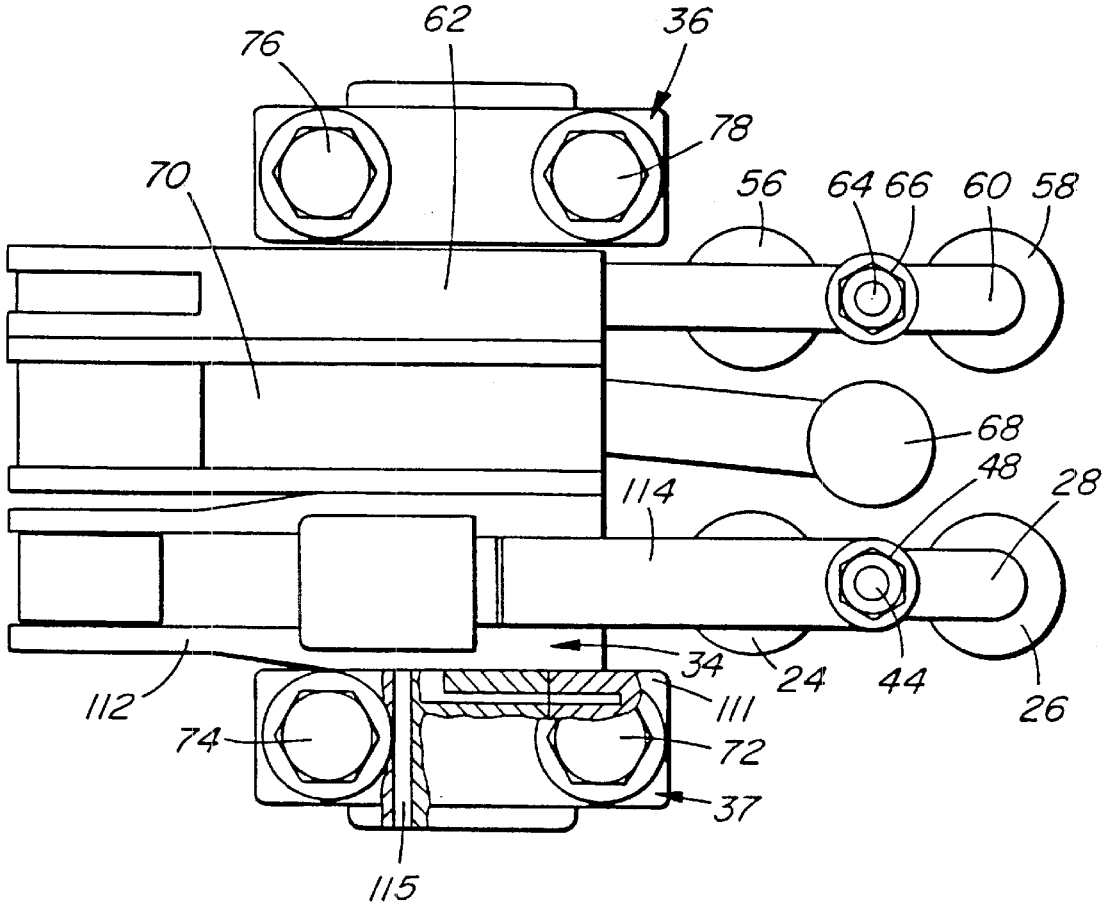
FIG. 6 is a top plan view similar to FIG. 4, for the position of FIG. 5.

Referring to FIG. 5, this shows a point after the lobe 25 has rotated past roller 40, and before lobe 23 has completed the lifting of the rocker arm 34 to open the exhaust valves 24 and 26 for the exhaust stroke. There is another hydraulic passageway 200.1 in portion 112 of the rocker arm which becomes aligned with passageway 115 in the shaft which is connected to drain. This allows pressurized oil to flow through passageway 200.1 from chamber 204 of cylinder 160, allowing spring 206 to move piston 162 to the right, from the point of view of FIG. 5, so stem 164 unseats ball 150 to the right, compressing spring 148. The force of projection 190 on piston 134, as the roller 40 rides up on lobe 23, forces the piston 134 to the left, from the point of view of FIG. 5, dumping oil through passageways 152,170, 113 and 110 back through the solenoid valve. Thus the two portions 112 and 114 of the rocker arm rotate closer together, increasing operative clearance between the exhaust valves and camshaft to the same amount as occurs when the engine brake is not operational.

Operation

Figure 3:
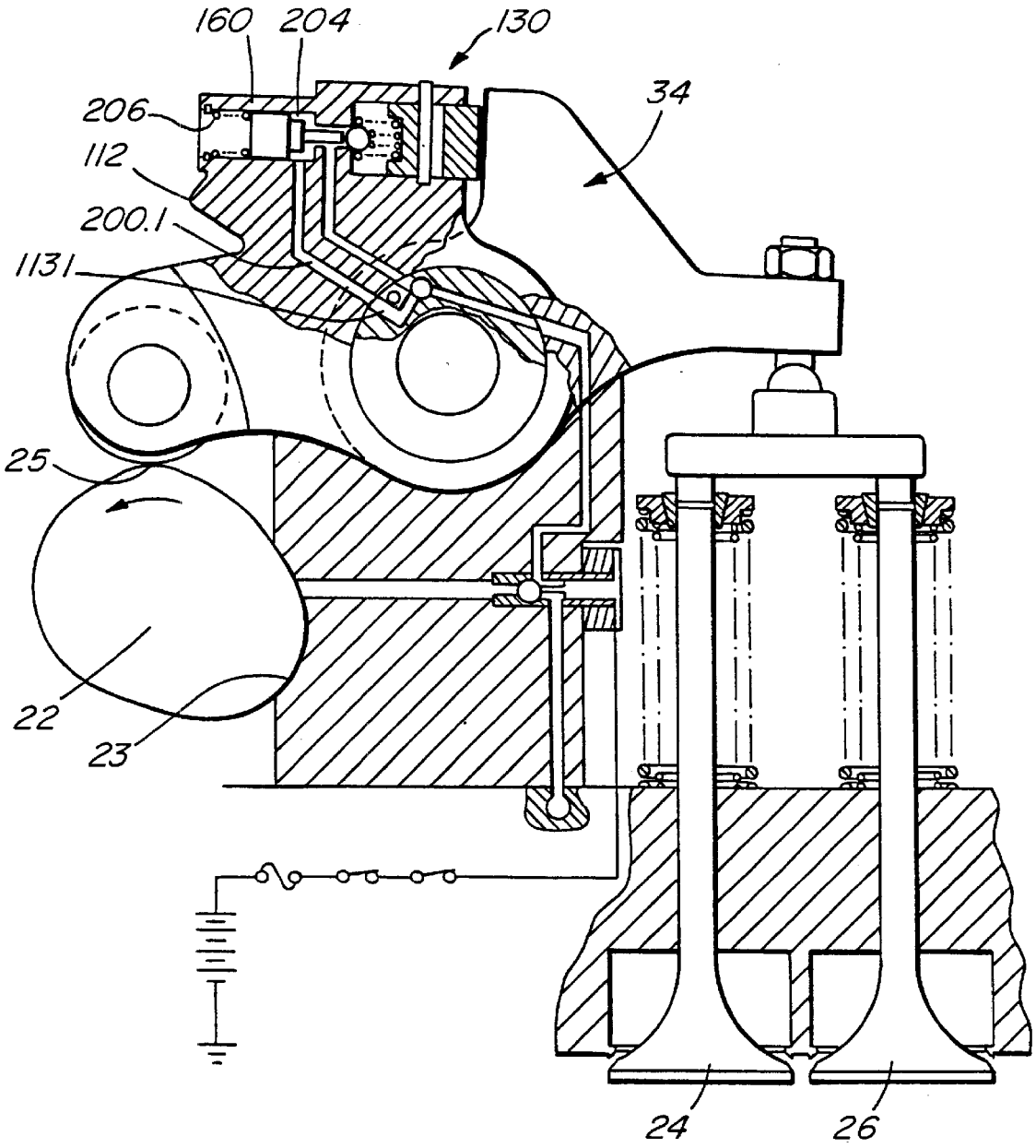
FIG. 3 is a view similar to FIG. 1 near the top dead center of the compression stroke with the exhaust valves fully cracked open.
Figure 4:
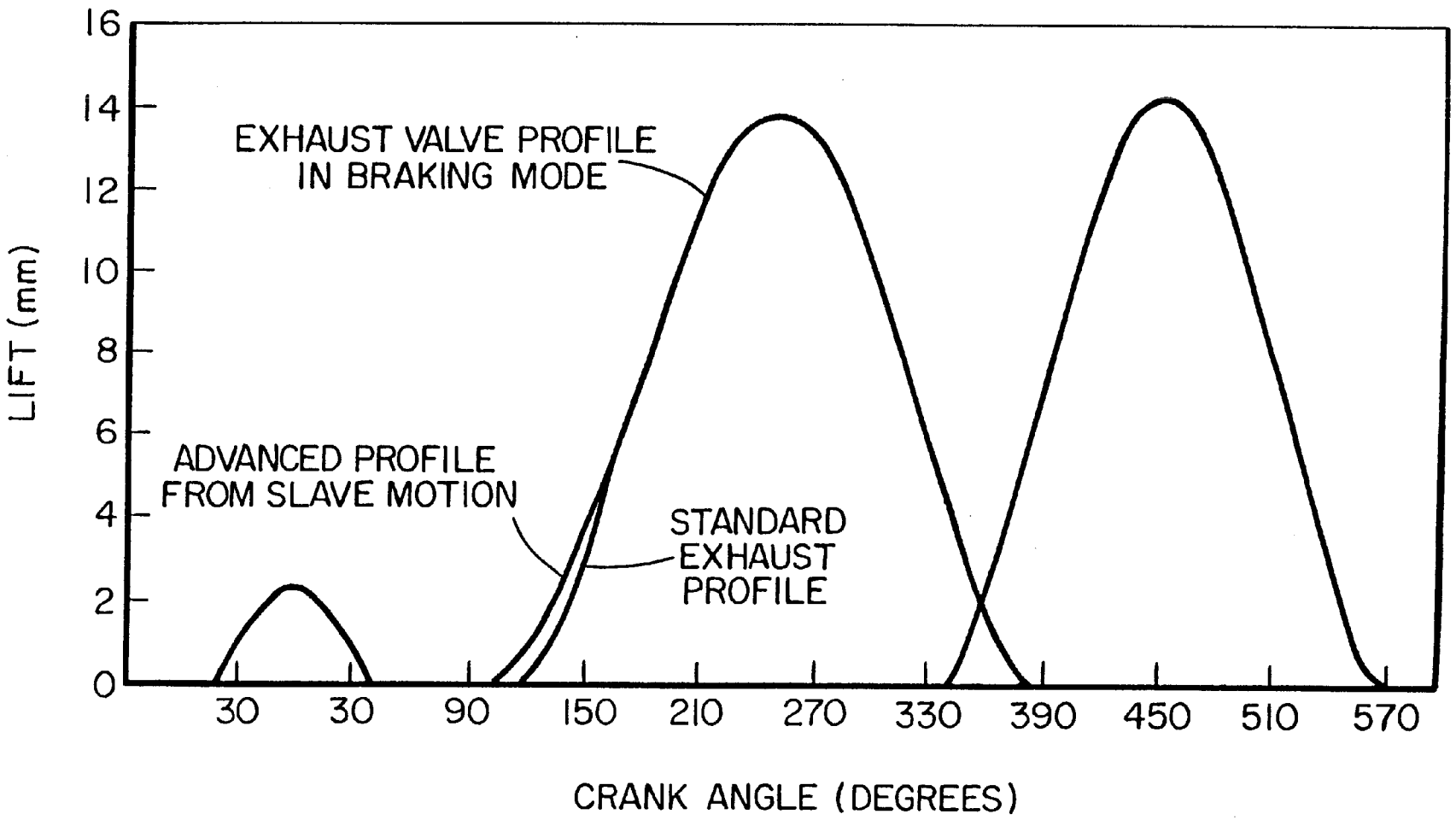
FIG. 4 is a graph which plots the lift of the exhaust valves against the crankshaft angle.

To summarize the operation of each cylinder of engine 20, FIG. 1 is first referenced. This shows the position of camshaft 22 as the roller 40 on the rocker arm 34 is on the dwell surface 21 of the camshaft, with its second lobe 25 approaching. Solenoid valve 102 has been opened using the controls 104. In this position passageways 110 and 170 in the rocker arm support and portion 112 of the rocker arm respectively are aligned with passageway 113 in shaft 38 such that engine oil is forced through passageway 152, past ball 150 and into the chamber 180 when piston 134 is moved to the right under the action of spring 140. The piston is prevented from moving to the left by the ball 150 which blocks the oil in the chamber 180. Thus the two portions 114 and 112 of the rocker arm are rotated away from each other, increasing the gap 200 between them and decreasing the operative clearance between the roller 40 and camshaft such that the lobe 25 on the camshaft rotates the rocker arm clockwise cracking open the exhaust valves 24 and 26, as shown in FIG. 3, as the roller rides up on lobe 25.

FIG. 5 shows the position of the apparatus after lobe 25 has passed the roller 40 and the roller is riding up on lobe 23. At this point passageway 200.1 in portion 112 of the rocker arm becomes aligned with passageway 115 in the shaft, which is connected to drain, allowing pressurized oil from chamber 204 of cylinder 160 to escape so spring 206 forces piston 162 to the right. This causes stem 164 to unseat ball 150. As roller 40 begins to ride up on lobe 23, portion 112 of the rocker arm is pushed upwardly by the camshaft, forcing projection 190 of portion 114 against piston 134 and forcing oil out from chamber 180 toward solenoid 102 through passageways 170, 111 and 110.

When the camshaft 22 has rotated such that the roller 40 is past the lobe 23 and is approaching lobe 25, as shown in FIG. 1, passageway 200.1 is aligned with passageway 113.1 in shaft 38. As seen, this receives oil from passageway 113 connected thereto. The hydraulic pressure pushes piston 162 to the left, along with stem 164, from the point of view of FIG. 1. Spring 148, shown in FIG. 7, biases ball 150 to the left so it reseats itself Passageways 110 and 170 are both aligned with passageway 113 in shaft 38 in this position such that oil again fills chamber 180 in cylinder 132 as piston 134 is biased to the right by spring 140. The oil is locked in chamber 180 by ball 150 so the portions 112 and 114 of the rocker arm are held in the relative position shown in FIG. 5 with the gap 200 increased, and the operative clearance between the roller 40 and the camshaft 22 decreased, so lobe 25 again cracks open the exhaust valves as it reaches roller 40.

Alternative Embodiments

Figure 9:
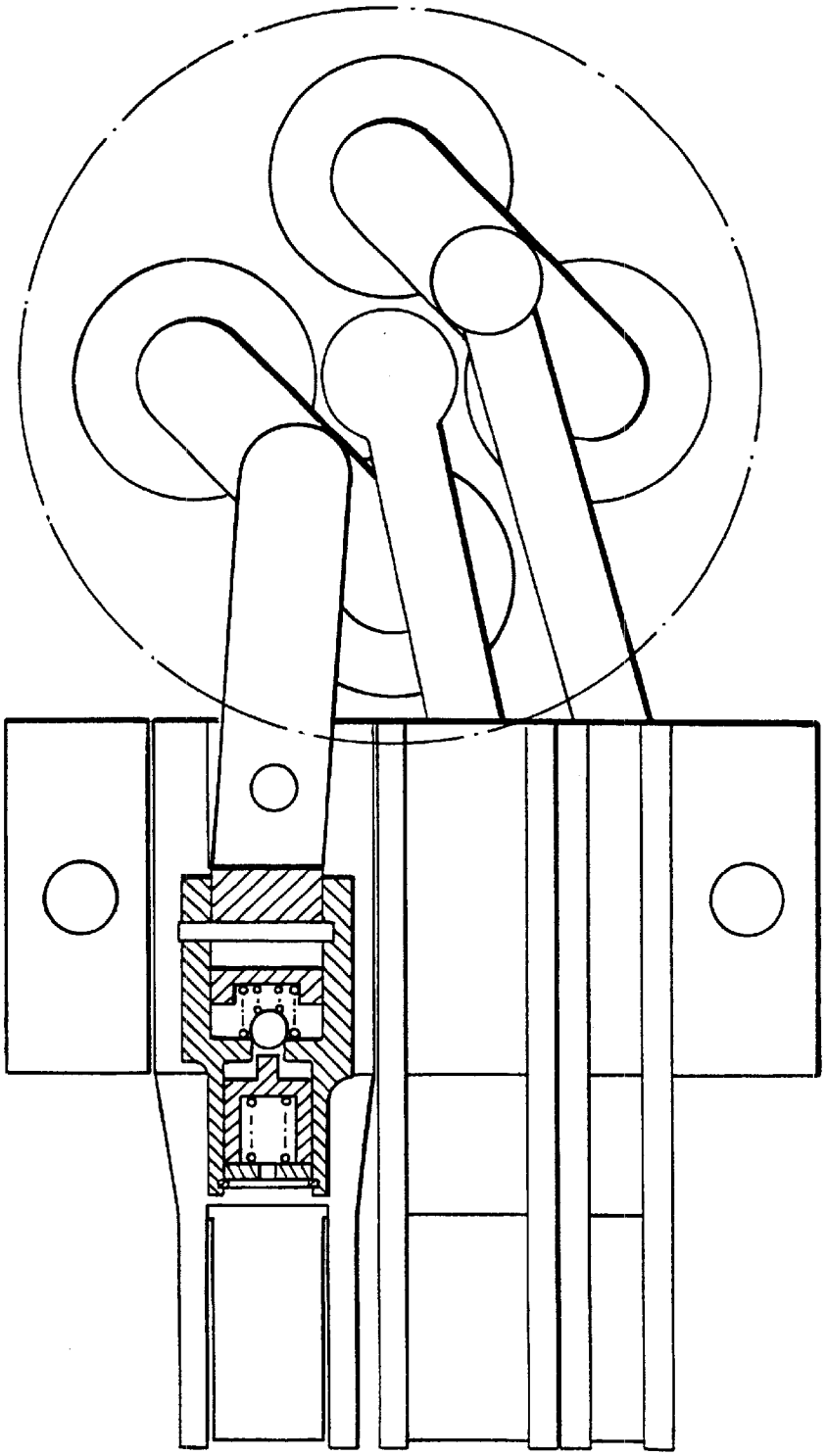
FIG. 9 is a view similar to FIG. 2 of a first alternative embodiment of the invention.

FIG. 9 show an alternative embodiment which is generally similar to the previous embodiment and like parts have like numbers with the additional designation "0.1". Like engine 20, engine 20.1 has a camshaft 22.1 with two lobes 23.1 and 25.1. Rocker arm 34.1 has two portions 112.1 and 114.1. There is a piston 134.1 which contacts projection 190.1 of portion 114.1. There is a ball 150.1 which normally seals passageway 170.1 against a back flow of oil from chamber 180.1.

There is a passageway 350 which connects chamber 180.1 to chamber 352 in a cylinder 354. There is a piston 356, 0.225" in diameter in this example, which slidingly extends through aperture 357 at end 359 of cylinder 354. A larger diameter, tubular piston 358, 0.250" in diameter in this example, extends slidingly and sealingly through aperture 361 at opposite end 360 of the cylinder. There is a screw 380 with a nylon insert 381 on the end which provides resistance against the movement of piston 358.

Figure 10:
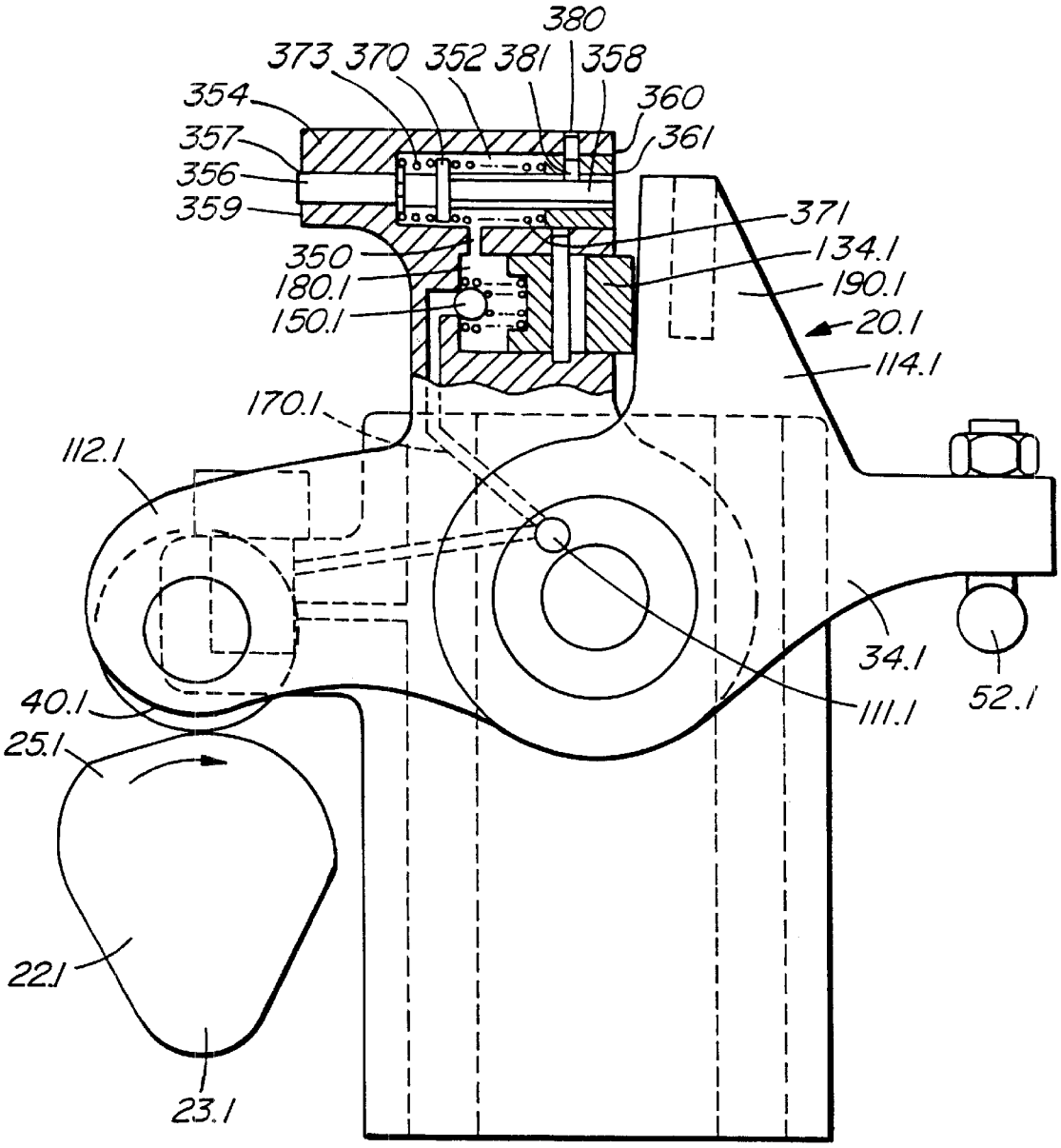
FIG. 10 is a view, similar to FIG. 1, of the third alternative embodiment.

There is a larger diameter spring 371 pressing against the disk-shaped member 370 and which biases the piston assembly to the left, from the point of view of FIG. 10. When chamber 180.1 is supplied with pressurized oil, as the lobe 25.1 approaches roller 40.1, pistons 356 and 358 are moved to the right due to the larger diameter of piston 358. This compresses spring 371. The pressure builds up as the roller 40.1 rides up on the lobe, causing piston 358 to project outwardly beyond the right end of cylinder 354 from the point of view of FIG. 10.

However, once the lobe 25.1 has caused the exhaust valves to crack open, the pressure in the engine cylinder rapidly drops due to the escape of the compressed gases through the exhaust valves. This reduces the pressure in cylinder 354, causing larger spring 371 to force member 370 to the left against the pressure of smaller spring 373, moving piston 356 to the left. However tubular piston 358 lags behind due to the resistance of nylon insert 381 pressing against the piston under the action of screw 380. Member 370 therefore separates from the tubular piston 358, allowing oil to escape from chamber 180.1 through the center of the tubular piston 358 and outwardly to the right from the point of view of FIG. 10. Thus piston 134.1 is forced towards chamber 180.1 by projection 190.1 as the roller 40.1 starts to ride on lobe 23.1, so the apparatus resumes its normal operational mode, equivalent to its position when the brake is not operational, prior to each exhaust stroke.

FIGS. 11–14 show another alternative embodiment wherein like parts have like numbers as in the previous embodiments with the additional designation "0.2". In this example rocker arm 34.2 has only a single portion instead of the two portions of the previous embodiments. However, rocker arm 34.2 is unconventional in that includes a mobile hydraulic finger 201, reciprocatingly received in a hydraulic cylinder 202. The finger has a convex outer end 205 which contacts crosshead 28.2. Rocker arm shaft 38.2 is provided with two passageways 210 and 212, the former aligning with passageway 110.2 to provide pressurized oil via solenoid 102.2. The latter is connected to drain.

There is a passageway 220 in the rocker arm equipped with a check valve 222 including a ball 224 biased against a seat 226 via spring 228. There is another passageway 230 which intersects passageway 221 between the check valve and cylinder 202.

Figure 11:
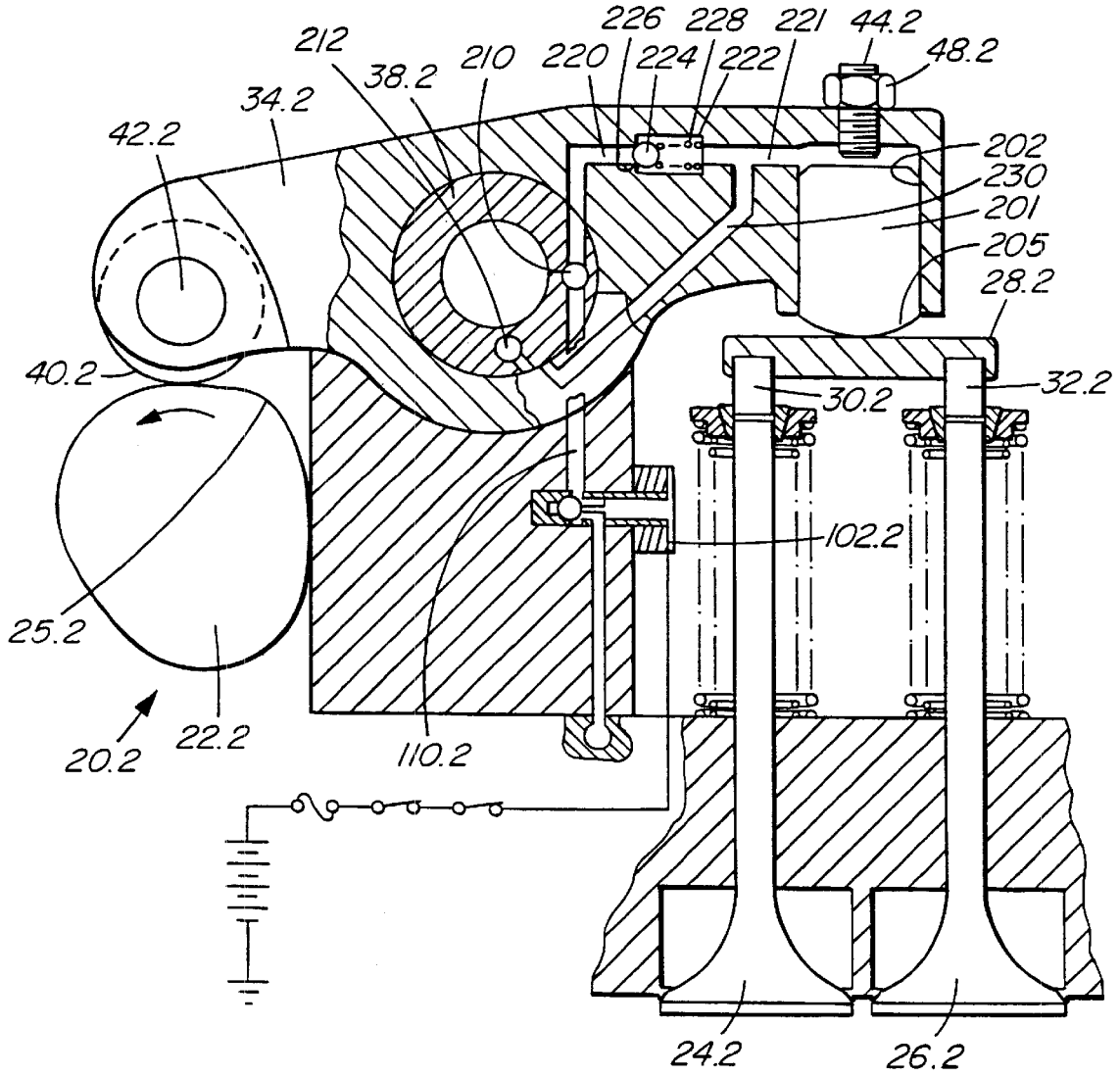
FIG. 11 is a view, similar to FIG. 1, of a second alternative embodiment.
Figure 12:
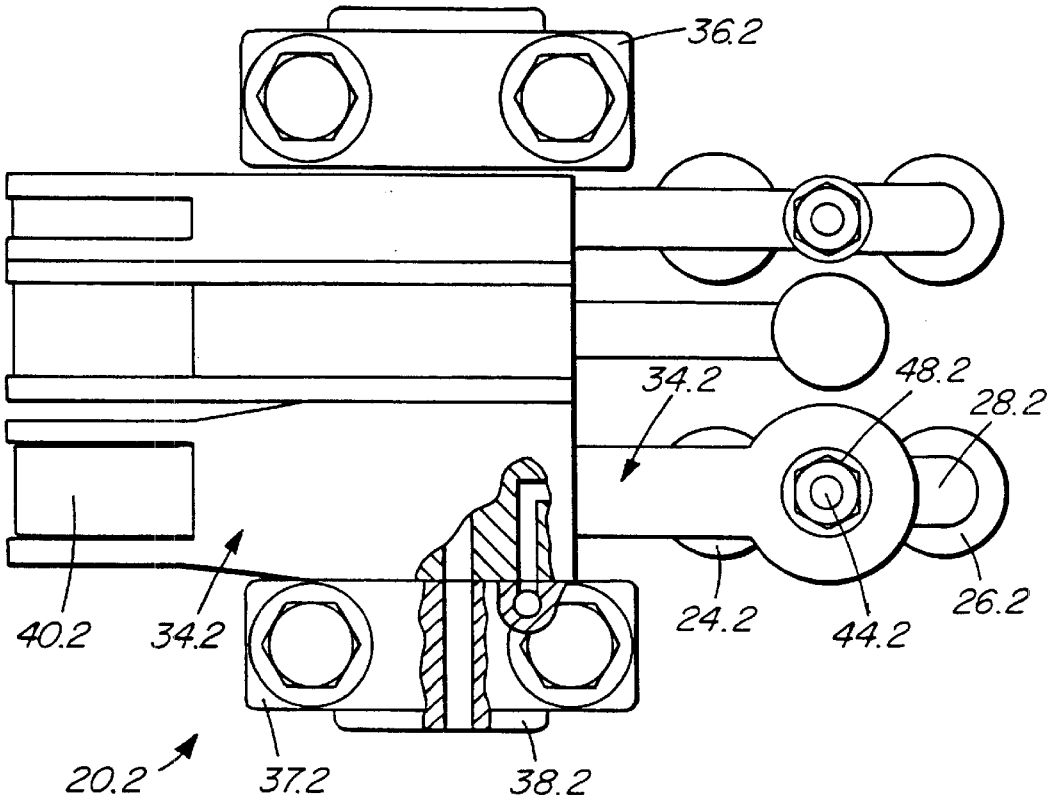
FIG. 12 is a view, similar to FIG. 2, of the second alternative embodiment.

As in the previous embodiments, lobe 25.2 serves to crack open the valves 24.2 and 26.2 near top dead center of the compression stroke. FIG. 11 shows lobe 25.2 approaching roller 40.2 of the rocker arm. It may be seen that passageway 220 is connected to passageway 110.2 via passageway 210 in the rocker arm shaft and thereby receives pressurized boil oil which passes through check valve 222 to enter cylinder 202 and thereby extend finger 201. The same time, passageway 230 is not aligned with the passageway 212 and thereby not connected to drain. Thus any oil entering cylinder 202 is trapped by the check valve and the nonalignment of passageway 230 with drain.

Figure 13:
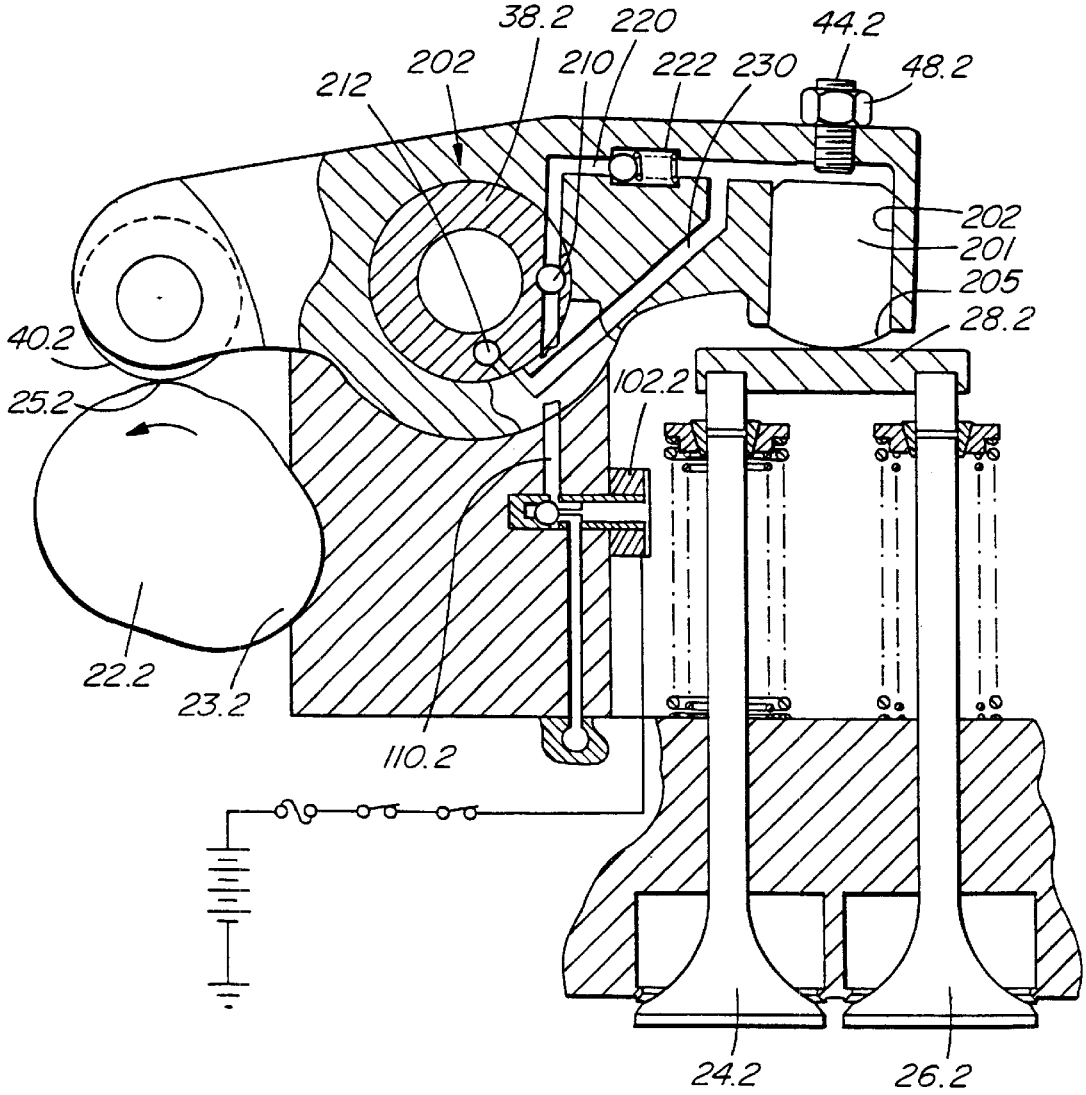
FIG. 13 is a view, similar to FIG. 3, of the second alternative embodiment.

Referring to FIG. 13, this shows the valves 24.2 and 26.2 fully cracked open near top dead center of the compression stroke. This is achieved with finger 201 fully extended.

Figure 14:
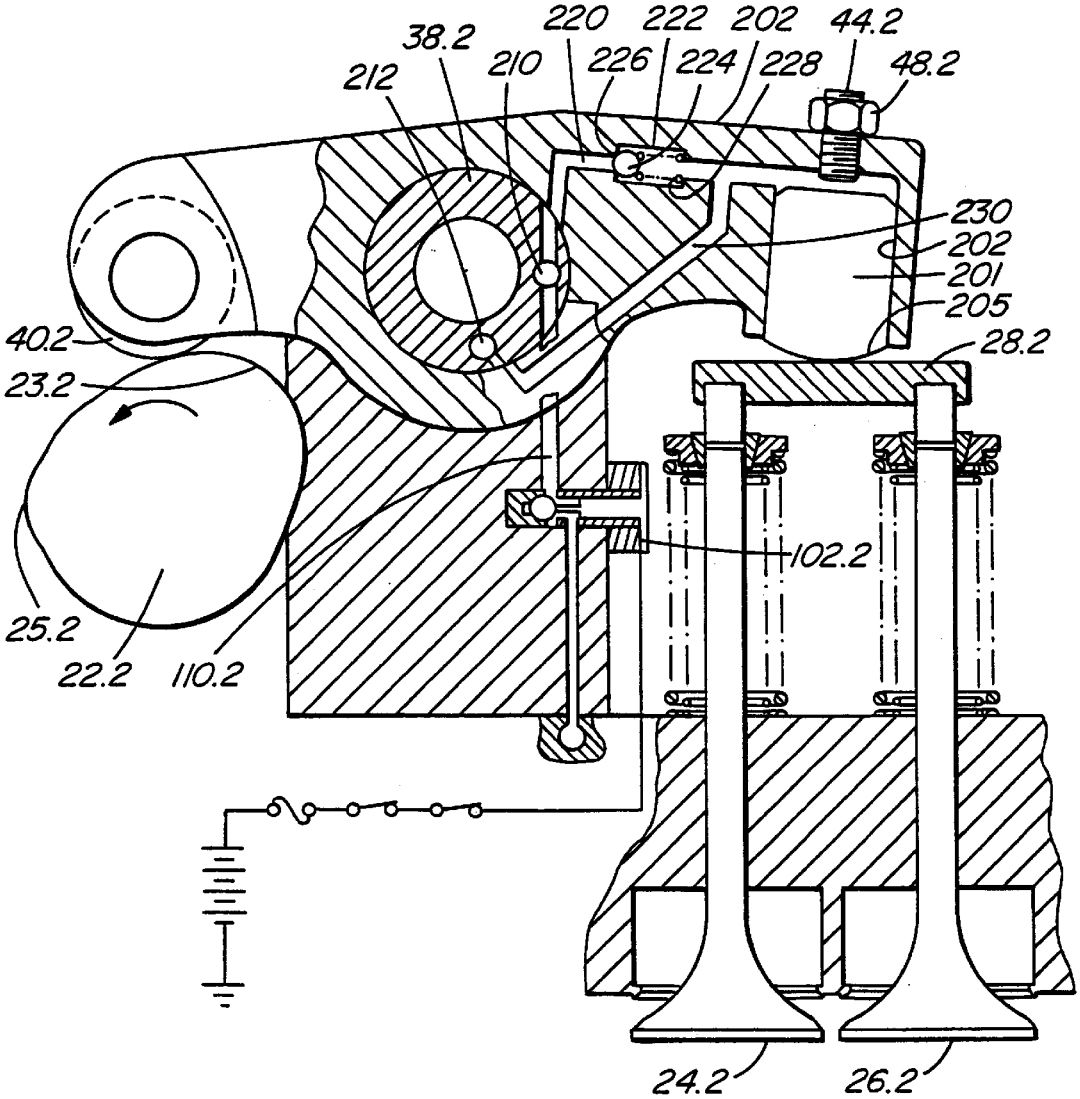
FIG. 14 is a view, similar to FIG. 4, of the second alternative embodiment.

Referring to FIG. 14, this shows the position of the camshaft 22.2 after lobe 25.2 has rotated past roller 40.2 and as the roller begins to ride up on lobe 23.2 for normal opening of the valves for the exhaust stroke. In this position, passageway 230 becomes aligned with passageway 212 and, thereby, to drain. This allows oil from cylinder 202 drain outwardly from the cylinder through passageway 230, thereby allowing finger 201 to retract until it contacts set screw 44.2. This is the position for normal valve opening where the lash and amount of valve opening are dictated by the position of screw 44.2.

It will be understood by someone skilled in the art that many of the details provided above are by way of example only and can be deleted or altered without departing from the scope of the invention as set out in the following claims.

What is claimed is:

1. A valve control apparatus for an internal combustion engine having a valve and a camshaft, the camshaft having an axis of rotation, a first lobe and a second lobe, the second lobe being angularly spaced-apart about the axis from the fist lobe, the first lobe extending further from the axis of rotation than the second lobe, the apparatus comprising:

a follower operatively engageable with the camshaft and the valve, the follower being positioned to operatively engage the first lobe on each revolution of the camshaft and thereby open said valve a first time on each revolution on the camshaft; and a mechanism for selectively changing operative clearance between the follower and at least one of the camshaft and the valve, the mechanism selectively reduces said clearance on each revolution of the camshaft, from a first clearance where the valve is opened by the first lobe, after the valve is opened by the first lobe, the follower operatively engaging the second lobe and opening the valve a second time on each revolution of the camshaft when the first clearance is so reduced, and said mechanism increasing the clearance to the first clearance on each revolution of the camshaft after the valve is opened the second time and before the valve is fully opened by the first lobe again.

2. A valve control apparatus for an internal combustion engine having a valve and a camshaft, the camshaft having an axis of rotation, a first lobe and a second lobe, the second lobe being angularly spaced-apart about the axis from the first lobe, the apparatus comprising:

a follower operatively engageable with the camshaft and the valve, the follower having a first operational mode where the first lobe operatively engages the follower on each revolution of the camshaft to open said valve a first time on each revolution on the camshaft and where the second lobe operatively clears the follower on each revolution of the camshaft without actuating said valve; and a mechanism for selectively putting the follower in a second operational mode where operative clearance between the follower and at least one of the camshaft and the valve is reduced, compared to the first mode, so the second lobe operatively engages the follower to open said valve a second time on each revolution of the camshaft, the second lobe clearing the follower during the first operational mode, the mechanism putting the follower in the second operational mode on each revolution of the camshaft before the second lobe rotates completely to alignment with the follower, the mechanism returning the follower to the first operational mode after the valve is opened by the second lobe and before the first lobe fully opens the valve, whereby maximum opening and normal closing of the valve by the first lobe is unaffected when the mechanism selectively puts the follower in the second operational mode.

3. An apparatus as claimed in claim 2, wherein the follower is a rocker arm.

4. An apparatus as claimed in claim 2, wherein the valve closes on each revolution of the camshaft after the first lobe passes the follower.

5. An apparatus as claimed in claim 3, wherein the rocker arm has two portions, a first portion operatively contacting the camshaft and a second portion operatively contacting the valve.

6. An apparatus as claimed in claim 5, wherein the mechanism for selectively putting the follower in the second operational mode includes a device for displacing the second portion of the follower relative to the first portion.

7. An apparatus as claimed in claim 6, wherein the two portions of the rocker arm are pivotally mounted on a rocker arm shaft, said device relatively displacing the two portions of the rocker arm about said shaft.

8. An apparatus as claimed in claim 6, wherein said device is a hydraulic device.

9. An apparatus as claimed in claim 8, wherein said device includes a chamber for hydraulic fluid, said chamber being closed and full of hydraulic fluid in one said operational mode and being opened to allow a discharge of said hydraulic fluid in another said operational mode.

10. An apparatus as claimed in claim 9, wherein said one mode is the second operational mode and said another mode is the first operational mode.

11. An apparatus as claimed in claim 9, wherein the device includes a hydraulic cylinder and piston, the chamber communicating with the cylinder.

12. An apparatus as claimed in claim 11, wherein the rocker arm shaft includes passageways to supply fluid to the chamber for the second operational mode and to drain fluid from the chamber for the first operational mode.

13. An apparatus as claimed in claim 2, wherein the engine has an exhaust stroke and a compression stroke, the valve being an exhaust valve, the first lobe being positioned on the camshaft to open the exhaust valve on said exhaust stroke of the engine, the second lobe being positioned on the camshaft to open the exhaust valve near top dead center of the compression stroke, whereby the apparatus functions as a compression release brake.

14. An apparatus as claimed in claim 3, wherein the rocker arm has an extendible hydraulic finger reciprocatingly received in a hydraulic cylinder, the finger operatively contacting the valve, the apparatus including means for supplying hydraulic fluid to the cylinder to extend the finger for the second operational mode and for draining hydraulic fluid from the cylinder for the first operational mode.

15. An internal combustion apparatus comprising:

an engine having a plurality of cylinders, each said cylinder having a valve;

a camshaft, the camshaft having an axis of rotation, a first lobe and a second lobe, the second lobe being angularly spaced-apart about the axis from the first lobe;

a follower operatively engageable with the camshaft and with the valve of said each cylinder, the follower having a first operational mode where the first lobe operatively engages the follower on each revolution of the camshaft to open said valve a first time and where the second lobe operatively clears the follower on each revolution of the camshaft without actuating said valve; and a mechanism for selectively putting the follower in a second operational mode where operative clearance between the follower and at least one of the camshaft and the valve is reduced, compared to the first mode, so the second lobe operatively engages the follower to open said valve a second time on each revolution of the camshaft, the mechanism putting the follower in the second operational mode on each revolution of the camshaft before the second lobe is fully aligned with the follower, the mechanism returning the follower to the first operational mode after the valve is opened by the second lobe and before the first lobe fully operatively engages the follower, whereby maximum opening and normal closing of the valve by the first lobe is unaffected when the mechanism selectively puts the follower in the second operational mode.

16. An apparatus as claimed in claim 15, wherein the follower is a rocker arm.

17. An apparatus as claimed in claim 15, wherein the valve closes on each revolution of the camshaft after the first lobe passes the follower.

18. An apparatus as claimed in claim 16, wherein the rocker arm has two portions, a first portion operatively contacting the camshaft and a second portion operatively contacting the valve.

19. An apparatus as claimed in claim 18, wherein the mechanism for selectively putting the follower in a second operational mode includes a device for displacing the second portion of the follower relative to the first portion.

20. An apparatus as claimed in claim 19, wherein the two portions of the rocker arm are pivotally mounted on a rocker arm shaft, said device relatively displacing the two portions of the follower about said shaft.

21. An apparatus as claimed in claim 19, wherein said device is a hydraulic device.

22. An apparatus as claimed in claim 21, wherein said device includes a chamber for hydraulic fluid, said chamber being closed and full of hydraulic fluid in one said operational mode and being opened to allow a discharge of said hydraulic fluid in another said operational mode.

23. An apparatus as claimed in claim 22, wherein said one mode is the second operational mode and said another mode is the first operational mode.

24. An apparatus as claimed in claim 22, including passageways in the rocker arm shaft for supplying hydraulic fluid to the chamber for the second operational mode and for draining hydraulic fluid from the chamber for the first operational mode.

25. An apparatus as claimed in claim 24, wherein the filling and draining of the chamber is actuated by rotation of the rocker arm about the rocker arm shaft.

26. An apparatus as claimed in claim 16, wherein the mechanism includes a hydraulic finger on the rocker arm which operatively contacts said valve and means for supplying hydraulic fluid to the finger to extend the finger for the second operational mode and to drain hydraulic fluid from the finger for the first operational mode.

27. An apparatus as claimed in claim 15, wherein the engine has an exhaust stroke and a compression stroke, the valve being an exhaust valve, the first lobe being positioned on the camshaft to open the exhaust valve on said exhaust stroke of the engine, the second lobe being positioned on the camshaft to open the exhaust valve near top dead center of the compression stroke, whereby the apparatus functions as a compression release brake.

28. A method of controlling valve actuation for an internal combustion engine having a valve and a camshaft, the method comprising the steps of:

providing a mechanism operatively connecting the valve and the camshaft;

providing two lobes on the camshaft for said valve, a first said lobe operatively engaging the mechanism to open the valve a first time on each revolution of the camshaft; and selectively adjusting the mechanism a first time on each revolution of the camshaft, from a first position where the first lobe engages the mechanism, but a second lobe clears the mechanism after the first lobe passes the mechanism, so the mechanism engages the second said lobe to open the valve a second time on each revolution of the camshaft, and adjusting the mechanism a second time on each revolution of the camshaft, back to said first position, after the second lobe opens the valve so the maximum opening and normal closing of the valve by the first lobe is unaffected after the mechanism is selectively adjusted the first time.

29. A method as claimed in claim 28, wherein the valve is an exhaust valve, the first lobe opening the valve on the exhaust stroke of the engine and the second lobe selectively opening the valve near top dead center of the compression stroke, thereby acting as a compression release brake.

30. A method as claimed in claim 28, wherein the valve closes after the first lobe passes the mechanism.

31. A method as claimed in claim 28, wherein the mechanism is selectively adjusted by hydraulic means.

32. A method as claimed in claim 28, wherein the mechanism includes a rocker arm, the rocker arm having two portions, the mechanism being selectively adjusted by displacing the two portions of the rocker arm relative to each other.

33. A method as claimed in claim 32, wherein the two portions of the rocker arm are each rotatable about a rocker arm shaft.

34. A method as claimed in claim 28, wherein the mechanism includes a hydraulic cylinder and piston, the mechanism being selectively adjusted the first time by supplying hydraulic fluid to the cylinder and being selectively adjusted the second time by draining hydraulic fluid from the cylinder.

* * * * *